US007427949B2

(12) United States Patent
Channabasappa et al.

(10) Patent No.: US 7,427,949 B2
(45) Date of Patent: Sep. 23, 2008

(54) SYSTEM AND METHOD OF USING ABSORBER-WALLS FOR MUTUAL COUPLING REDUCTION BETWEEN MICROSTRIP ANTENNAS OR BRICK WALL ANTENNAS

(75) Inventors: Eswarappa Channabasappa, Acton, MA (US); Robert Egri, Wayland, MA (US)

(73) Assignee: M/A-COM, Inc., Lowell, MA (US)

( * ) Notice: Subject to any disclaimer, the term of this patent is extended or adjusted under 35 U.S.C. 154(b) by 287 days.

(21) Appl. No.: 11/294,172

(22) Filed: Dec. 5, 2005

(65) Prior Publication Data

US 2007/0126620 A1 Jun. 7, 2007

(51) Int. Cl.
*H01Q 17/00* (2006.01)

(52) U.S. Cl. ..... 342/198; 342/1; 342/4

(58) Field of Classification Search ..... 342/1–4, 342/175, 198

See application file for complete search history.

(56) References Cited

U.S. PATENT DOCUMENTS 4,044,357 A * 8/1977 Goldie ..... 342/200
4,697,189 A 9/1987 Ness ..... 343/700
4,821,041 A 4/1989 Evans ..... 343/700
4,931,752 A * 6/1990 Bray et al. ..... 333/151
5,966,169 A * 10/1999 Bullis ..... 348/81
6,545,641 B2 4/2003 Ghosh et al. ..... 343/700
2007/0126620 A1 * 6/2007 Channabasappa et al. ..... 342/1
2007/0126638 A1 6/2007 Channabasappa

FOREIGN PATENT DOCUMENTS

JP 2006194887 A * 7/2006

OTHER PUBLICATIONS

"Microstrip Antennas Integrated With Electromagnetic Band-Gap (EBG) Structures: A Low Mutual Coupling Design for Array Applications" by F. Yang IEEE Transactions on Antennas and Propagation, vol. 51, No. 10, Oct. 2003 pp. 2936-2946.

"Mutual Coupling Between Reduced Surface-Wave Microstrip Antennas" by Khayat et al. IEEE Transactios on Antennas and Propagation, vol. 48, No. 10, Oct. 2000 pp. 1581-1593.

* cited by examiner

*Primary Examiner*—John B Sotomayor

(57) ABSTRACT

A multi-element antenna with sufficiently small return loss and mutual coupling signals to allow the simultaneous transmission of powerful radar signals and the reception of faint target return signals. The microstrip patch antenna has radio frequency absorbing material place between neighboring antenna elements to reduce the mutual coupling leakage signals.

20 Claims, 9 Drawing Sheets

SYSTEM AND METHOD OF USING ABSORBER-WALLS FOR MUTUAL COUPLING REDUCTION BETWEEN MICROSTRIP ANTENNAS OR BRICK WALL ANTENNAS

FIELD OF THE INVENTION

The present invention relates to antennas for use in pulsed radar applications, and more particularly to co-located microwave radar antennas capable of simultaneously transmitting and receiving pulsed signals.

BACKGROUND OF THE INVENTION

Pulsed radar is a well known technique for detecting objects at a distance. A high-power radio frequency (RF), pulsed signal is transmitted in the direction of a target object, and the signal reflected off the object is detected by a sensitive receiver. The distance to the target may be determined by measuring the time delay between transmitting the signal and receiving signal reflected from the target. A velocity of the target may also be determined by measuring any frequency change of the reflected signal.

In a pulsed radar system used for detecting the presence of small objects at large distances, the detection sensitivity is limited by the amount of energy in the reflected pulse (also known as the return pulse) when it reaches the receiving antenna. The energy in the return pulse can be increased by increasing the pulse length. For a given transmission power and reception sensitivity, the detection sensitivity of the radar system can, therefore, be improved by increasing the length of the pulses in the pulsed signal. There is, however, a limit to how long the radar pulse can be made.

Because the target is small and far away, the return signal in the radar system is many orders of magnitude smaller than the transmitted signal. Furthermore, a transmission antenna can only be exactly impedance matched at a narrow band of frequencies, so that in any real radar system having a finite bandwidth signal, a small fraction of the transmitted signal is reflected back from the antenna along the radar's receive path in what is known as a return loss leakage signal.

If the radar system has multi-element, patch antennas, something that is highly desirable for radar beam steering, there is the additional problem of leakage from a transmitting element to the return path of one or more neighboring antenna elements, known as leakage due to mutual coupling.

In systems that are being used to locate small objects at a distance and that have collocated transmit and receive antennas, the transmitter is, therefore, turned off when the receiver is turned on, in order to avoid losing the faint return signal in the leakage signals. As a result, the length of the pulse that can be used in such systems is limited to the time an RF pulse takes to reach and return from the target. For a target at a distance of 300 km, the return time is about 500 msec.

One way to overcome this return time limit is to have separate transmit and receive antennas that are located sufficiently far apart that the transmitted signal does not couple into the receive antenna. The receiver can then operate at the same time as the transmitter and the pulse length is no longer limited by the return time.

In many practical situations, such as radar systems on aircraft or automobiles, it is not possible to separate the receiving and transmitting antenna sufficiently for them to operate at the same time. It is, therefore, highly desirable to have antennas, particularly multi-element, patch antennas, in which the magnitude of the return loss and mutual coupling leakage signals can be made sufficiently small that a weak return signal can be detected by the receiver even when the co-located transmitting antenna is being used at full power, thereby allowing very long pulse lengths to be used.

SUMMARY OF THE INVENTION

The present invention relates to an antenna system, method and apparatus that allows the return loss and mutual coupling leakage signals of an antenna to be made sufficiently small that the antenna may be used to simultaneously transmit and receive, even if the transmission is of powerful radar signals and the reception is of faint target return signals.

In a preferred embodiment of the invention, a microstrip patch antenna has radio frequency (RF) absorbing material placed between neighboring antenna elements to reduce the mutual coupling leakage signals.

The horizontal size of a microstrip patch antenna element may be reduced by capacitive loading by, for instance, providing a back cavity with controlled opening. This reduction in horizontal size relative to the size of a typical microstrip patch antenna element operating at a comparable wavelength, effects some reduction in mutual coupling. The size reduction also creates sufficient space between adjacent patch antenna elements to allow enough RF absorbing material to be placed there to further reduce mutual coupling.

To provide a large bandwidth, patch antenna elements may have one or more parasitic patches stacked above the driven patch. These parasitic or passive patches may be reduced in relative size by, for instance, slotting.

In this preferred embodiment, there is a slight reduction in the power output of the antenna due to the absorbing material but no appreciable distortion of the antenna radiation patterns. Despite the slight reduction in power output, the overall sensitivity of a pulsed radar system using such an antenna in detecting small objects at a large distance is significantly improved because of the ability to simultaneously transmit and receive, which allows significantly longer pulses to be used.

These and other features of the invention will be more fully understood by references to the following drawings.

DETAILED DESCRIPTION

The present invention provides a system, method and apparatus for reducing antenna internal losses, including any finite return loss or mutual coupling losses. The system, method and apparatus are particularly suitable for reducing the finite return and mutual coupling loses in a stacked microstrip patch antenna so that is suitable for use as a microwave or radio frequency (RF) phased array antenna.

In a preferred embodiment that is suitable for use in radar applications, a compact, high directivity antenna having a multiplicity of transmitting elements has the mutual coupling losses between these elements reduced by placing a ring of microwave or RF absorbing material between the elements. In a further embodiment of the invention metal elements may also be used as part of the RF absorbing ring separating the antenna elements.

The horizontal size of a microstrip patch antenna element may be reduced by capacitive loading by, for instance, providing an underlying back cavity with controlled openings as described in detail in a related patent application entitled "Compact Broadband Patch Antenna" by E. Channabasappa published as US patent publication 2007-0126638 on Jun. 7, 2007, the contents of which are hereby incorporated by reference. The back cavity also helps to lower mutual coupling by suppressing surface waves, and to widen the bandwidth over which the return loss can be reduced.

This reduction in horizontal size relative to the size of a typical microstrip patch antenna element operating at a comparable wavelength, effects some reduction in mutual coupling. The size reduction also creates sufficient space between adjacent patch antenna elements to allow enough RF absorbing material to be placed there to further reduce mutual coupling.

To provide a large bandwidth, patch antenna elements may have one or more parasitic patches stacked above the driven patch. These parasitic/stacked patches may be reduced in relative size by, for instance, slotting. The slots provide longer current paths, thus making the size of the stacked patch smaller.

The invention will now be described in more detail by reference to the accompanying drawings in which, as far as possible, like numbers represent like elements.

Figure 1:
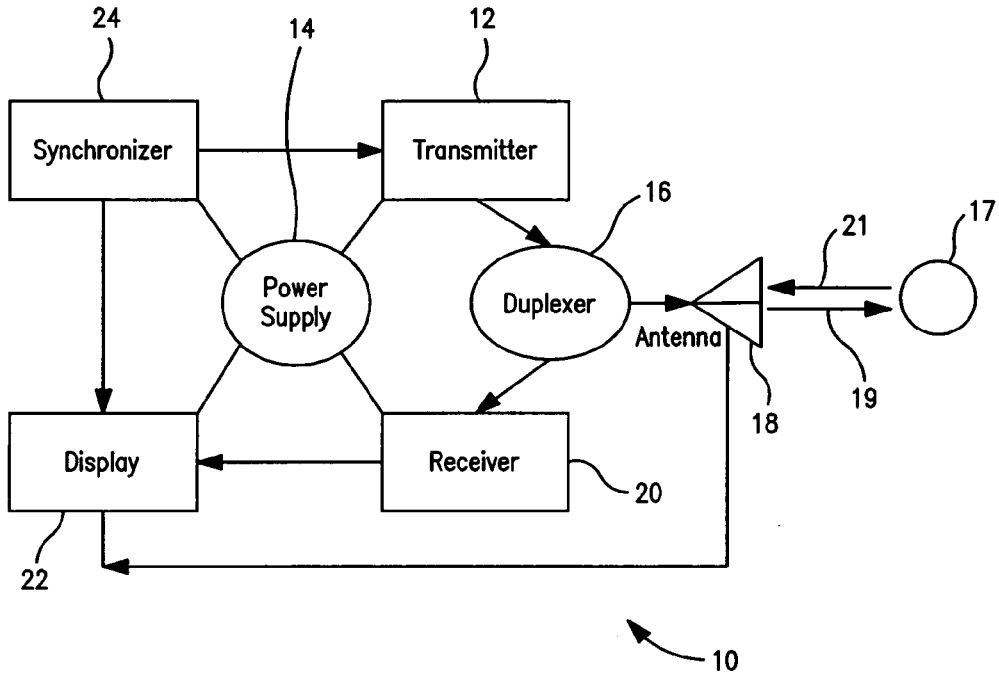
FIG. 1 is schematic overview showing the elements of a typical radar system.

FIG. 1 is a schematic overview showing the elements of a typical radar system 10 having a transmitter 12, a power supply 14, a duplexer 16, an antenna 18, a receiver 20, a display 22 and a synchronizer 24.

The transmitter 12 is a suitably high power radio frequency (RF) transmitter modulated at the appropriate pulse width for the pulsed radar.

The receiver 20 is a suitably sensitive RF receiver that can receive the small return signal.

The synchronizer 24 allows the display 22 . to compare the timing and frequency of the signals transmitted by the transmitter 12 and received by the receiver 20 and display results associated with those comparisons. In particular, the synchronizer 24 allows the display 22 to measure a time delay between transmitting a particular pulse of a pulse modulated signal 19 and receiving the corresponding pulse 21 after reflection off a target 19. This measured time delay can be used to calculate and display the distance from the antenna 18 to the target 19.

The duplexer 16 is a device that allows radiation from the transmitter to be fed to the antenna but not to the receiver, and similarly for radiation from the antenna to be fed to the receiver but not to the transmitter.

An antenna duplexer 16 that is well know in the radar industry is the ferrite circulator, which uses a nonreciprocal behavior of ferrite, known as Faraday rotation, to separate signals. Faraday rotation is the observation that a linearly polarized wave propagating a fixed distance though a ferrite will emerge with the direction of the linear polarization rotated through a fixed angle. Moreover, this rotation does not depend on the direction of propagation (forward or backward).

Figure 2:
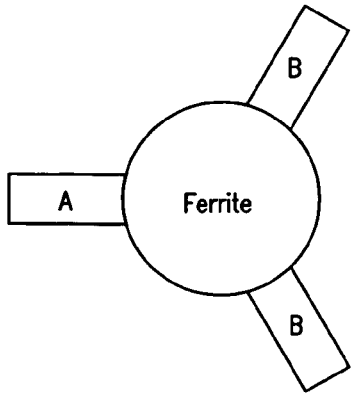
FIG. 2 is schematic diagram showing a ferrite circulator.

FIG. 2 is schematic diagram showing a ferrite circulator that is a passive, three-port device. The inputs to the ferrite circulator are linearly polarized by transmission through a rectangular wave-guide port. The ferrite circulator's three ports A, B, C are arranged to propagate waves having phase rotations of 0, 120 and 240 degrees respectively, and in which the internal ferrite induces a Faraday rotation through 120 degrees. Then, an input at port A couples into B but not C, and input at B couples into C but not A, and an input at C couples into A but not B.

By using a ferrite circulator as an antenna duplexer 16, the RF transmission from transmitter 12 can be coupled to the antenna 18 but not the receiver 20, while the signal received by the antenna 18 can be coupled to the receiver 20, but not to the transmitter 12.

An antenna duplexer would allow the radar to operate by simultaneously transmitting and receiving signals from the antenna, if there were no return losses or mutual coupling losses.

Figure 3A:
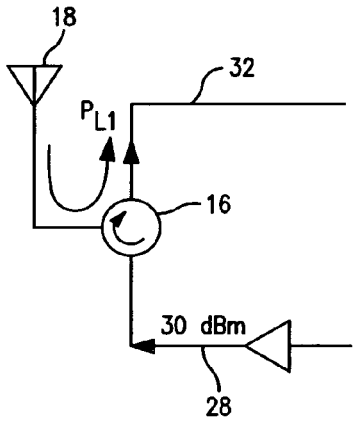
FIG. 3A is a schematic diagram illustrating the problem of finite return losses in a radar system having a collocated antenna.

FIG. 3A is a schematic diagram illustrating the problem of finite return losses in a radar system having a collocated antenna and being fed through a duplexer. A powerful, 30 dBm signal 28 may, for instance, be guided via an antenna duplexer 16 to the antenna 18. The antenna 18 is usually designed to be impedance matched to the medium of transmission (air has an impedance of 377 ohms) in order for all the available power to be transmitted. It is only possible, however, to exactly impedance match any circuit at a narrow range of frequencies. If the signal being transmitted has a range of frequencies, there will be a slight impedance mismatch at the other frequencies. The result of this impedance-mismatch is that a small amount of the signal fed to the antenna is reflected back as the return loss $P_{L1}$ and is steered into the radar receiving circuit 32. Although this return loss $P_{L1}$ signal is a very small fraction of the transmitted signal, typically −20 dB relative to the transmitted , it is a problem in radar applications in which small objects are being detected at a distance, because the return signal from the object is also very small and may also only be of the order of −20 dB or less of the transmitted signal. If the transmitter and receiver operate at the same time, such a small return signal from the target is going to be hidden or lost in the return loss signal.

Figure 3B:
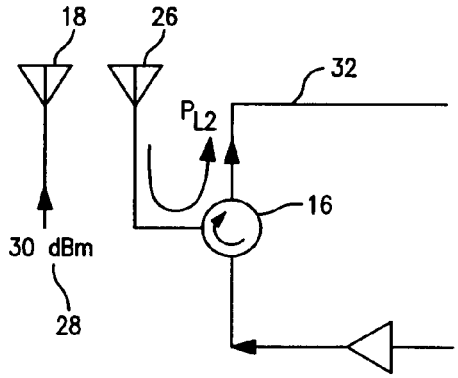
FIG. 3B is a schematic diagram illustrating a related problem of mutual coupling that occurs with antennas that have multiple elements such as a phased array antenna.
Figure 10A:
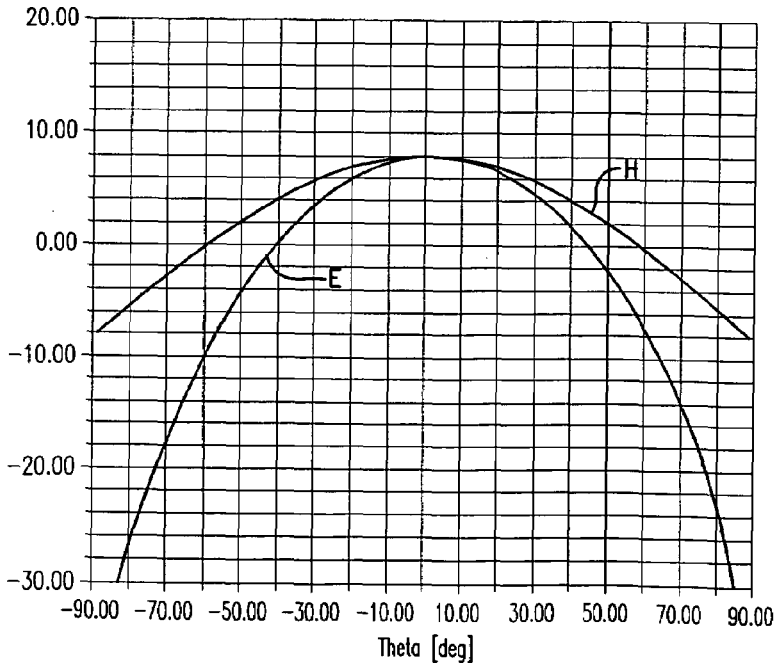
FIG. 10A is a graph showing the predicted radiation pattern in decibels as a function of angle in degrees for the central element of the 5×5 array having absorbers rings in accordance with a preferred embodiment of the present invention.

FIG. 3B is a schematic diagram illustrating a related problem of mutual coupling that occurs with antennas that have multiple elements, such as the well-known phased array antennas or the microstrip patch antennas. The antenna 18 may, for instance, be fed by a 30 dBm transmission signal. Each individual element or patch typically has a dome shaped radiation pattern with the radiation in a given direction being approximately equal to the cosine of the angle between the direction of radiation and the normal to the element surface, as shown in, for instance, FIGS. 10A and 10B. Because of the finite thickness of the antenna elements, there is a resultant small cross-coupling between neighboring antenna elements. This small mutual coupling signal $P_{L2}$ is steered via the antenna duplexer 16 into the radar receiving circuit 32. The magnitude of the leakage signal due to mutual coupling is typically about −10 dB relative to the transmission signal, so that when the transmission signal is 30 dBm, the leakage signal due to mutual coupling would typically be 20 dBm.

Figure 4A:
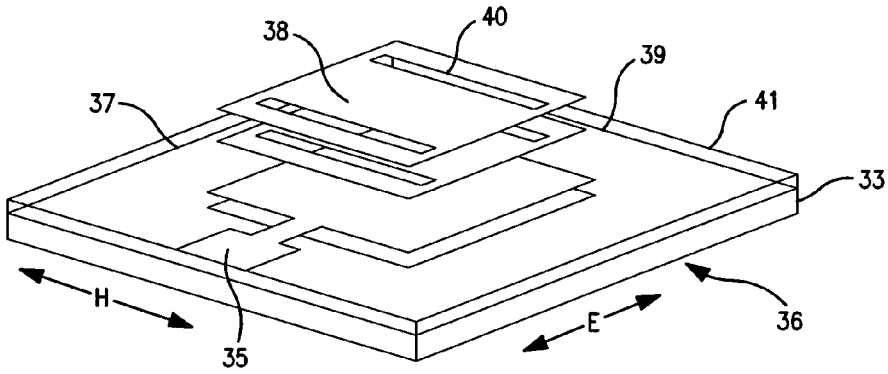
FIG. 4A is a schematic drawing of a single capacitive loaded, stacked patch antenna element (with two stacked patches).

FIG. 4A is a schematic drawing of a single capacitive loaded, stacked patch antenna element 36 having two stacked patches.

The patch antenna element 36 comprises a conducting base 33, a dielectric substrate 41, a driver patch 37, a driver feed element 35, back cavity with controlled opening 39 and at least one stacked, parasitic patch element 38. The parasitic or passive patch elements 38 may have one or more slots 40.

The back cavity with controlled opening 39 effectively provides a capacitive load to the driver patch 37, allowing the horizontal size of the drive element to be reduced relative to the horizontal size of a patch element with no capacitive loading.

The stacked, parasitic patch elements 38 are added to increase the frequency bandwidth. The size of the parasitic patch elements 38 are reduced by the slots 40.

For a patch element operating at 10 GHz, and having a wavelength of 30 mm, the capacitive loaded driver patch has horizontal dimensions of about 10 mm. The overall height of the antenna element including one stacked patch is about 3.5 mm.

The direction of maximum radiation of patch antenna element 36 is normal to the plane of the antenna element. The transmitted radiation is linearly polarized, with the electric field vector E perpendicular to the edge of the driven patch 37 that is connected to the driver feed element 35, and hence perpendicular to the direction of the slots 40. The magnetic field vector H is parallel to the direction of the slots 40. It is, therefore, useful to define the E plane as the plane containing the electric field vector and the direction of maximum radiation, and the H plane as the plane containing the magnetic field vector and the direction of maximum radiation. These planes are used as references to plot the radiation patterns.

Figure 4B:
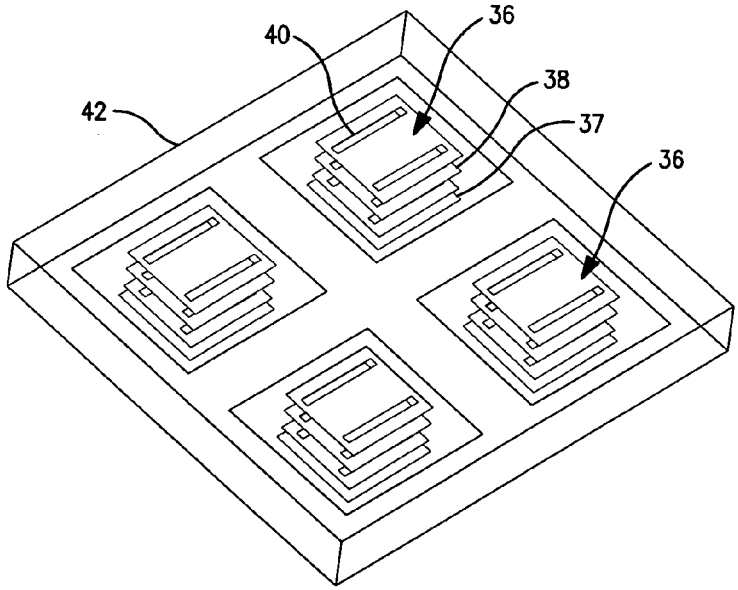
FIG. 4B is a schematic drawing of a four-element antenna array having absorber rings in accordance with a preferred embodiment of the present invention.

FIG. 4B is a schematic drawing of a four-element antenna array with absorber rings. Each element 36 of the antenna array comprises a driver patch 37 and at least one stacked patch element 38. The passive patch elements 38 may have one or more slots 40. Each of the elements 36 is separated from each other by a portion of an absorber wall or ring 42. Placing a radio frequency absorber between the antenna elements substantially reduces the mutual coupling signal between the elements.

A typical patch antenna has patch elements that are approximately $\lambda/2$ in width and breadth, where $\lambda$ is the wavelength of the radiation being transmitted by the array. The center-to-center spacing of the elements is typically only slightly larger than $\lambda/2$. In a preferred embodiment, the width of the driver patch 37 and the stacked patch element 38 are both approximately $\lambda/4$. This reduction in relative size of the driver patch may be achieved by capacitive loading. The parasitic or passive patch elements 38 may reduced in size by mean of the slots 40. The center-to-center separation of the elements 36 remains, however, approximately $\lambda/2$. This allows room for RF absorbing material to be placed between them in order to reduce mutual coupling.

The RF absorbing material may be, but is not limited to, a graded dielectric absorber, in which absorption is achieved by a gradual tapering of impedance from that of free space to a highly lossy state. If this transition is done smoothly, little RF radiation is reflected off the material. A typical absorbing medium comprises conductive carbon granules suspended in a polyurethane foam. By varying the number of carbon granules per unit volume of the material, the impedance of the material can be varied. Absorption levels of greater than 50 dB can be obtained with material that is many wavelengths thick, and good levels of reflectivity reduction (greater than 20 dB) can be achieved in materials less than one-third wavelength thick. This method of gradual impedance transition may also be applied to other materials including, but not limited to, honeycombs and netting. These and other RF absorbing materials are commercially available from, for instance, R&F Products, of San Marcos, Calif. 92069.

In a preferred embodiment, the RF absorbing material was Eccosorb FGM and Eccosorb GDS, which are registered trademarks for RF absorbing material supplied by Emerson & Cuming of Randolph, Mass. In the preferred embodiment, the absorber sheets thickness varied from 1 to 2 mm, and the height varied from 3 to 7.5 mm. Such material has an attenuation of about 40 dB/cm at 10 GHz.

Figure 5:
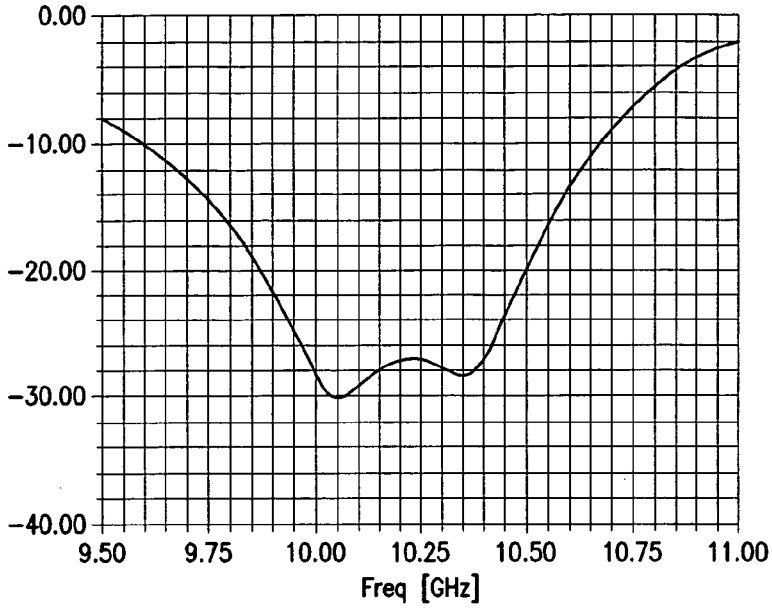
FIG. 5 is a graph showing the predicted input return loss for the stacked patch antenna.

FIG. 5 is a graph showing the predicted input return loss of the single stacked patch antenna element having one stacked patch and no absorbers The initial optimization of the antenna assumed an operational frequency of 10 GHz. The width of the driver patch was 10 mm, and the width of the stacked patch was 9.42 mm. These sizes may be reduced further relative to the wavelength of the radiation by using dielectrics such as, but not limited to, an appropriate plastic or ceramic having a relative permeability greater than 1. The return loss, in dB, plotted against frequency, is shown optimized for a pulse bandwidth of 500 MHz over which there is a return loss of 25 dB. Other optimization runs obtained a 20 dB return loss over 700 MHz, and a return loss of 40 dB over 200 MHz. Additional slotted stacked patches may result in larger bandwidths having similar return losses.

Figure 6A:
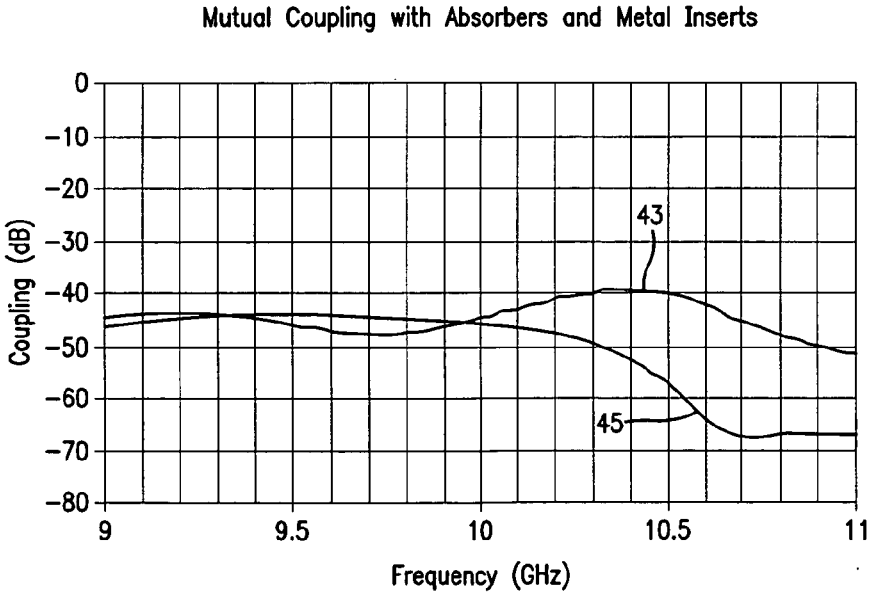
FIG. 6A is a graph showing the predicted mutual coupling between the two stacked patch antenna elements with absorber rings and metal sheets, in accordance with a further embodiment of the present invention.

FIG. 6A is a graph showing the predicted mutual coupling between the two stacked patch antenna elements, each of which has one slotted stacked patch, with absorber rings and metal sheets. Metal inserts may be added in the H-plane, where the beams are broader, in addition to the sheets of absorber material. In a preferred embodiment, the metal inserts may be copper foil attached to the sheets of RF absorbing material. The computed mutual coupling between two antenna elements, with center to center spacing of 0.54λ, is plotted in the E-plane 45 and the H-plane 43. The maximum coupling obtained in both E- and H-planes is lower than −40 dB over more than 500 MHz frequency bandwidth around 10 GHz. This is extremely small when compared to a typical value of about −10 dB without absorbers. The estimated reduction in gain due to these absorbers is about 2 to 3 dB, which may be improved by making the antenna elements even smaller relative to the operational wavelength.

TABLE 1

Comparison of a 10 GHz antenna having 0.54λ element spacing constructed in accordance with the present invention compared with prior art, related antenna. The transmission signal is a 30 dBm signal.

Figure 7:
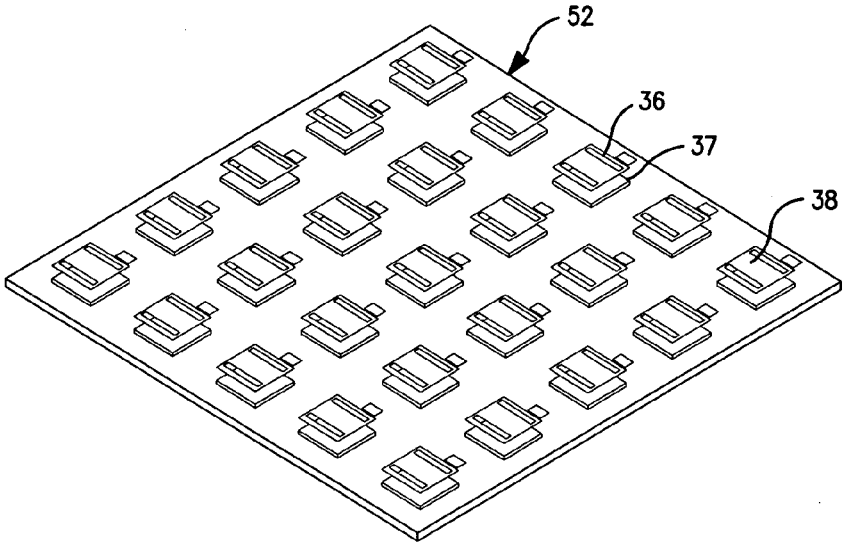
FIG. 7 is an isometric drawing showing a 5×5 array antenna having no absorber rings.
Figure 8:
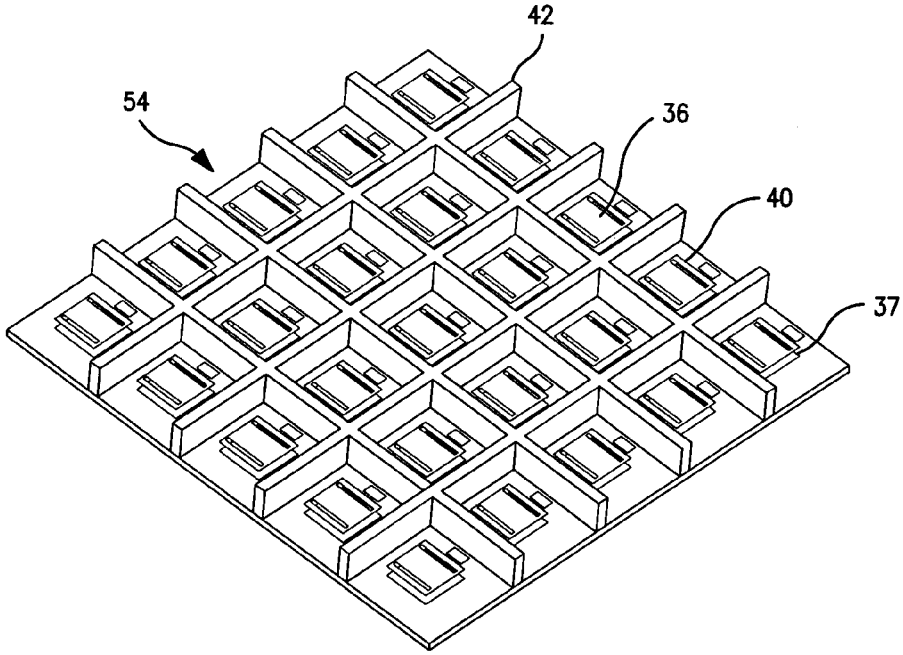
FIG. 8 is an isometric drawing showing a 5×5 array antenna having absorber rings in accordance with a preferred embodiment of the present invention.

| | Frequency Bandwidth | Antenna Return Loss | Leakage Signal due to Return Loss (PL1) | Antenna Mutual Coupling | Leakage Signal due to Mutual Coupling (PL2) |
|---|---|---|---|---|---|
| Present State of the art Stacked Patch Antenna (Without Mitigation Effect) | 500 MHz | −20 dB | 10 dBm | −10 dB | 20 dBm |
| Slotted Stacked Microstrip Patch Antenna (As shown in FIG. 7) | 200 MHz | −40 dB | −10 dBm | −16 dB | 14 dBm |
| Slotted Stacked Microstrip Patch Antenna (As shown in FIG. 7) | 500 MHz | −25 dB | 5 dBm | −16 dB | 14 dBm |
| Slotted Stacked Microstrip Patch Antenna with Absorbing Rings and Metal Inserts (As shown in FIG. 8) | 500 MHz | −25 dB | 5 dBm | −40 dB | −10 dBm |

Table 1 shows a comparison of various antennas constructed in accordance with the present invention compared with prior art, related antennas. In particular, the first row of the table details performance characteristics of a state of the art, prior art stacked patch antenna having an operating frequency of 10 GHz, elements spaced at 0.54λ and an operating bandwidth of 500 MHz has a return loss of −20 dB and a mutual coupling loss of −10 dB. If such an antenna is used to transmit a 30 dBm signal, the return loss signal is, therefore, 10 dBm and the mutual coupling signal is 20 dBm.

In contrast, row 2 details performance characteristics of one embodiment of the present invention having slotted, stacked microstrip patches and an operating frequency of 10 GHz, with elements spaced at 0.54λ that has a return loss of −40 dB and a mutual coupling loss of −16 dB measured over an operating bandwidth of 500 MHz. If such an antenna is used to transmit a 30 dBm signal, the return loss signal is, therefore, −10 dBm and the mutual coupling signal is 14 dBm.

Row 3 details performance characteristics of the same embodiment of the invention as row 2, but measured over a 500 MHz operating bandwidth. The return loss is reduced to −25 dB over this range, while the mutual coupling loss remains −16 dB. If such an antenna is used to transmit a 30 dBm signal, the return loss signal over this bandwidth is, therefore, 5 dBm and the mutual coupling signal is 14 dBm.

In further contrast, row 4 details the performance characteristics of a further embodiment of the invention, in which the novel slotted stacked microstrip patch antenna has RF absorbing rings and metal inserts. This embodiment of the invention also has an operating frequency of 10 GHz, elements spaced at 0.54λ. When measured over an operating bandwidth of 500 MHz, the embodiment of row 4 has a return loss of −25 dB and a mutual coupling loss of −40 dB. If such an antenna is used to transmit a 30 dB signal, the return loss signal is, therefore, 5 dB and the mutual coupling signal is −10 dB.

Figure 6B:
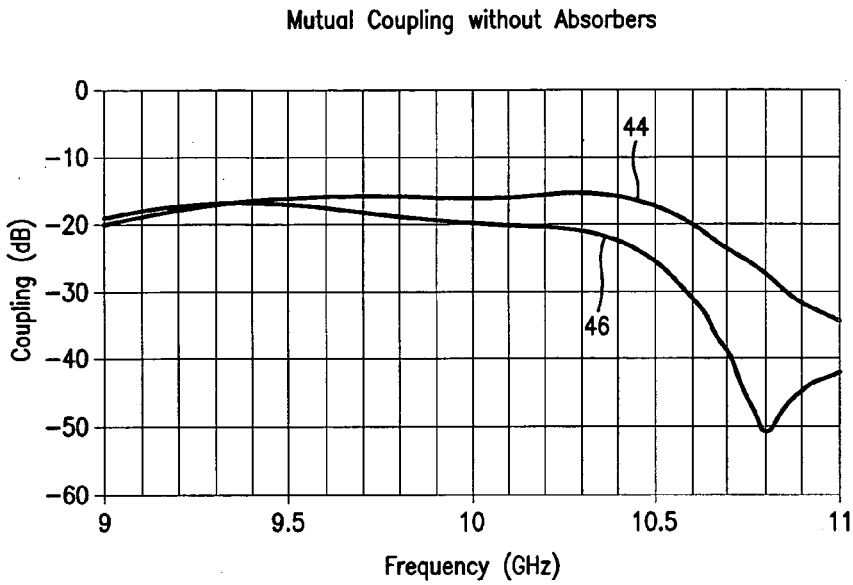
FIG. 6B is a graph showing the mutual coupling between the two stacked patch antenna elements without absorbers as a function of frequency.

FIG. 6B is a graph showing the mutual coupling between the two stacked patch antenna elements without absorbers as a function of frequency. The computed mutual coupling between two antenna elements, with center to center spacing of 0.54λ, is plotted in the E-plane, 46, and the H-plane 44. The maximum coupling obtained in both E- and H-planes is lower than −15 dB over more than 500 MHz frequency bandwidth around 10 GHz.

Figure 6C:
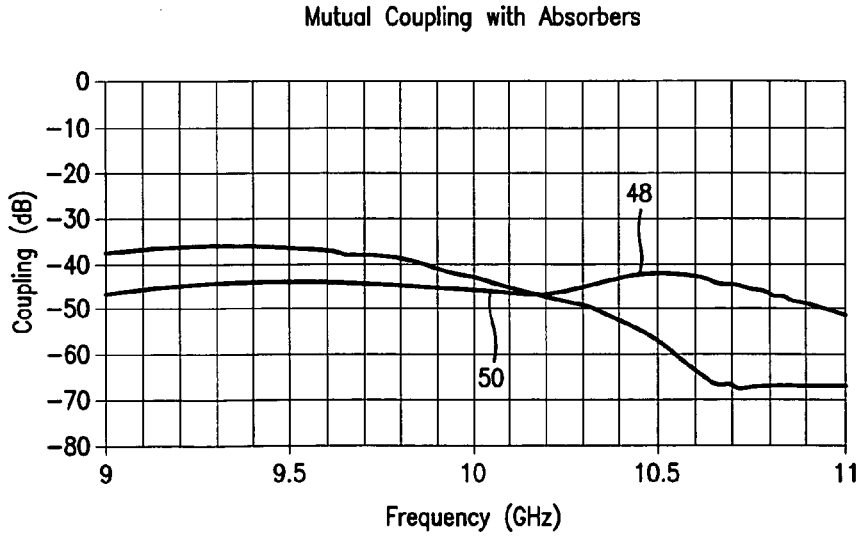
FIG. 6C is a graph showing the mutual coupling between the two stacked patch antenna elements having absorbers in accordance with a preferred embodiment of the present invention, plotted as a function of frequency.

FIG. 6C is a graph showing the mutual coupling between the two stacked patch antenna elements with absorbers as a function of frequency. The computed mutual coupling between two antenna elements, with center to center spacing of 0.54λ, is plotted in the E-plane, 50, and the H-plane 48. The maximum coupling obtained in both E- and H-planes is lower than −35 dB over more than 500 MHz frequency bandwidth around 10 GHz.

FIG. 7 is an isometric drawing showing a 5×5 array antenna with no absorber rings.

FIG. 8 is an isometric drawing showing a 5×5 array antenna with absorber rings, in accordance with a preferred embodiment of the present invention.

FIGS. 9-13B illustrate the predicted performance differences between prior art antenna, antenna constructed in accordance with the present invention and ideal antenna having no mutual coupling.

Figure 9:
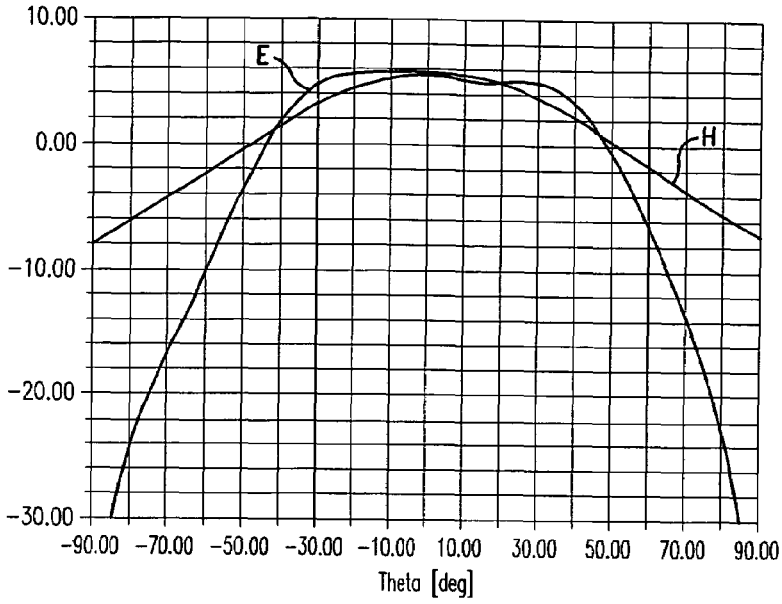
FIG. 9 is a graph showing the predicted radiation pattern in decibels as a function of angle in degrees for the central element of the 5×5 array having no absorber rings.

In particular, FIG. 9 is a graph showing the predicted radiation pattern in decibels as a function of angle in degrees for the central element of the 5×5 array having no absorbers rings as illustrated by FIG. 7, with center-to-center spacing of 0.54λ and an operation frequency centered on 10 GHz. The radiation pattern is plotted in the E-plane and the H-plane.

FIG. 10 is a graph showing the predicted radiation pattern in decibels as a function of angle in degrees for the central element of the 5×5 array having absorbers rings in accordance with a preferred embodiment of the present invention as illustrated by FIG. 8, with center-to-center spacing of 0.54λ and an operation frequency centered on 10 GHz. The radiation pattern is plotted in the E-plane and the H-plane.

In comparing the radiation patterns of FIG. 9 and FIG. 10, the distortions in the FIG. 9 pattern indicate that the mutual coupling is very strong. This may result in gain reduction as well as poor impedance matching as the distorted beam of FIG. 9 is scanned.

Figure 11A:
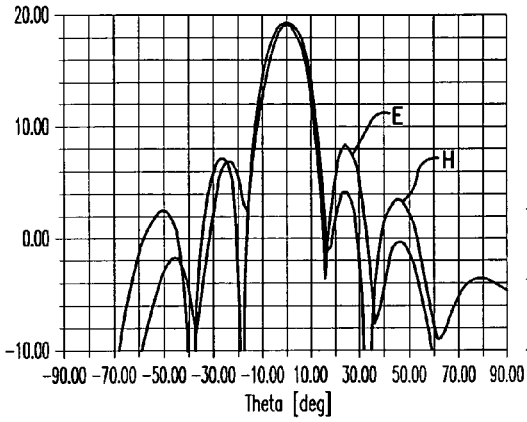
FIG. 11A is a graph of the predicted radiation pattern (accounting for mutual coupling) of the 5×5 array antenna with uniform excitation amplitudes and no absorber rings.

FIG. 11A is a graph of the predicted radiation pattern of the 5×5 array antenna uniform excitation amplitudes with no absorber rings as illustrated by FIG. 7, with center-to-center spacing of 0.54λ and an operation frequency centered on 10 GHz. The radiation pattern is plotted in the E-plane and the H-plane.

Figure 11B:
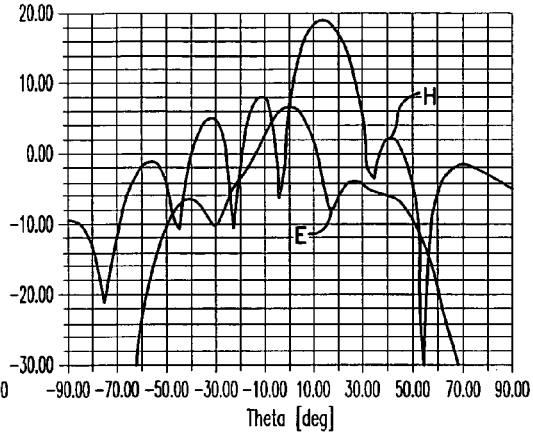
FIG. 11B is a graph of the predicted radiation pattern (accounting for mutual coupling) of the 5×5 array antenna with uniform excitation amplitudes and a 15 degree scan angle with no absorber rings.

FIG. 11B is a graph of the predicted radiation pattern of the 5×5 array antenna with uniform excitation amplitudes and a 15 degree scan angle with no absorber rings as illustrated by FIG. 7, with center-to-center spacing of 0.54λ and an operation frequency centered on 10 GHz. The radiation pattern is plotted in the E-plane and the H-plane.

Figure 12A:
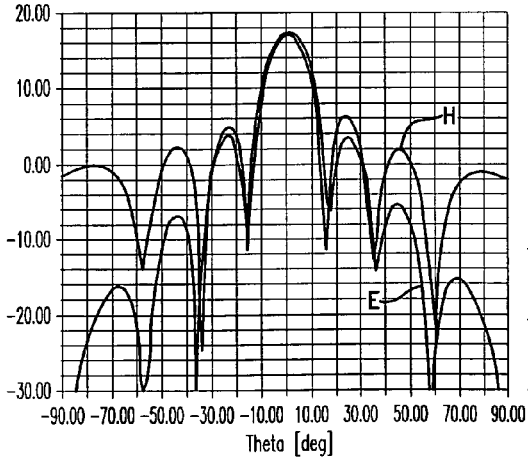
FIG. 12A is a graph of the predicted radiation pattern (accounting for mutual coupling) of the 5×5 array antenna uniform excitation amplitudes with absorber rings in accordance with a preferred embodiment of the present invention.

FIG. 12A is a graph of the predicted radiation pattern of the 5×5 array antenna uniform excitation amplitudes with absorber rings in accordance with a preferred embodiment of the present invention as illustrated by FIG. 8, with center-to-center spacing of 0.54λ and an operation frequency centered on 10 GHz. The radiation pattern is plotted in the E-plane and the H-plane.

Figure 12B:
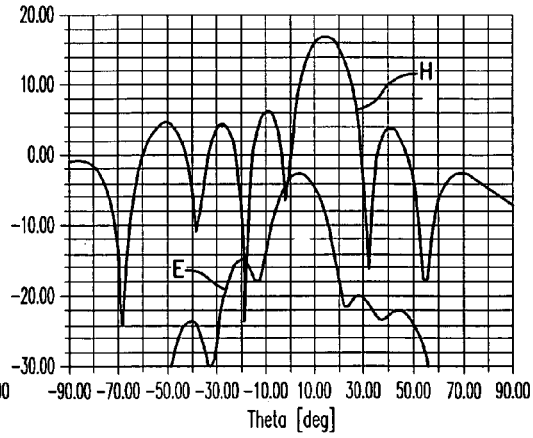
FIG. 12B is a graph of the predicted radiation pattern (accounting for mutual coupling) of the 5×5 array antenna with uniform excitation amplitudes and a 15 degree scan angle with absorber rings in accordance with a preferred embodiment of the present invention.

FIG. 12B is a graph of the predicted radiation pattern of the 5×5 array antenna with uniform excitation amplitudes and a 15 degree scan angle with absorber rings in accordance with a preferred embodiment of the present invention as illustrated by FIG. 8, with center-to-center spacing of 0.54λ and an operation frequency centered on 10 GHz. The radiation pattern is plotted in the E-plane and the H-plane.

Figure 13A:
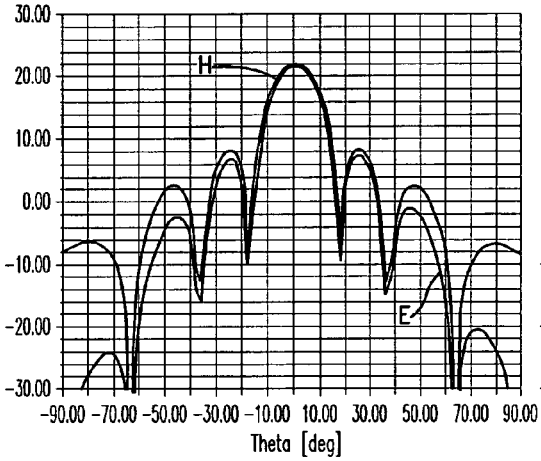
FIG. 13A is a graph of the predicted radiation pattern, computed using a single element pattern and an array factor, of the 5×5 array antenna uniform excitation amplitudes with no mutual coupling.

FIG. 13A is a graph of the predicted radiation pattern of an ideal, 5×5 array antenna uniform excitation amplitudes with no mutual coupling, with center-to-center spacing of 0.54λ and an operation frequency centered on 10 GHz. The radiation pattern is plotted in the E-plane and the H-plane. The close correspondence between this graph of the ideal case have no mutual coupling with the graph of FIG. 12A shows the effectiveness of absorbing material between the antenna elements.

Figure 13B:
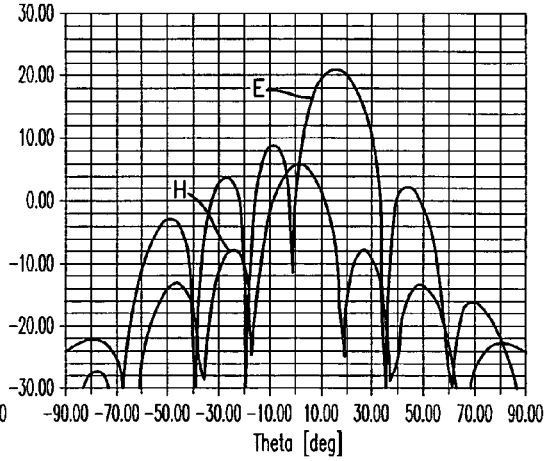
FIG. 13B is a graph of the predicted radiation pattern, computed using a single element pattern and an array factor, of the 5×5 array antenna with uniform excitation amplitudes and a 15 degree scan angle with no mutual coupling.

FIG. 13B is a graph of the predicted radiation pattern of the 5×5 array antenna with uniform excitation amplitudes and a 15 degree scan angle with no mutual coupling, with center-to-center spacing of 0.54λ and an operation frequency centered on 10 GHz. The radiation pattern is plotted in the E-plane and the H-plane. The discrepancy between the plot of the ideal case of no mutual coupling and the graph of FIG. 12B may be accounted for by the slow convergence of the electromagnetic simulator which had to be stopped prematurely.

Although the invention has been described in language specific to structural features and/or methodological acts, it is to be understood that the invention defined in the appended claims is not necessarily limited to the specific features or acts described. Rather, the specific features and acts are disclosed as exemplary forms of implementing the claimed invention

What is claimed is:

1. A method for simultaneously transmitting and receiving signals from an antenna, said method comprising the steps of:

providing a first and a second patch antenna element;

locating a radio frequency absorber between said first and second patch antenna elements such that a mutual coupling signal between said first and second patch antenna elements is reduced; and transmitting a radio frequency signal using at least one of said patch antenna elements while receiving said radio frequency signal using at least one of said patch antenna elements.

2. The method of claim 1 further comprising the steps of providing an antenna duplexer; providing a radio frequency transmitter; providing a radio frequency receiver; and connecting said radio frequency transmitter and said radio frequency receiver to said first and second patch antenna elements via said antenna duplexer.

3. The method of claim 2 wherein said transmitted radio signal is a pulse modulated signal; said received radio frequency signal is a portion of said transmitted radio signal after reflection off a target; and further comprising measuring a time delay between transmitting and receiving corresponding pulses of said pulse modulated signal; and determining a distance from said antenna elements to said target using said measured time delay.

4. The method of claim 2 wherein said antenna duplexer is a ferrite circulator.

5. The method of claim 2 wherein said first and second patch antenna elements each comprise a driver patch and one or more stacked layers of conducting material separated by an air gap, thereby reducing a return loss signal of said patch antenna elements.

6. The method of claim 5 wherein each of said stacked layers further comprises a substantially flat layer of conducting material containing one or more slots, thereby further reducing said return loss of said patch antenna elements.

7. The method of claim 6 wherein said mutual coupling signal is reduced to at least −40 dB over a 500 MHz bandwidth and said return loss signal is reduced to at least −25 dB over a 500 MHz bandwidth.

8. The method of claim 6 further comprising locating one or more metal inserts between said first and second patch antenna elements.

9. An antenna suitable for use in radar, comprising:

a first and a second patch antenna element;

a radio frequency absorber located between said first and second patch antenna elements such that a mutual coupling signal between said first and second patch antenna elements is reduced.

10. The antenna of claim 9 wherein said first and second patch antenna elements each comprise a driver patch and one or more stacked layers of conducting material separated by an air gap, thereby reducing a return loss signal of said first and second patch antenna elements.

11. The antenna of claim 10 wherein each of said stacked layers further comprises a substantially flat layer of conducting material containing one or more slots, thereby further reducing said return loss signal of said first and second patch antenna elements.

12. The antenna of claim 11 wherein said mutual coupling signal is reduced to at least −40 dB over a 500 MHz bandwidth and said return loss signal is reduced to at least −25 dB over a 500 MHz bandwidth.

13. The antenna of claim 11 further comprising one or more metal inserts between said first and second patch antenna elements.

14. The antenna of claim 9 further comprising a transmitter and receiver connected to said patch antenna elements such that simultaneous transmission and reception may occur.

15. A system for simultaneously transmitting and receiving signals from an antenna, comprising:

a first and a second patch antenna element;

absorber means for absorbing a radio frequency, said absorber means situated between said first and second patch antenna elements such that a mutual coupling signal between said first and second antenna elements is reduced;

transmitter means for transmitting a first radio frequency signal using said first and second patch antenna elements; and receiver means for receiving a second radio frequency signal using said first and second patch antenna elements, said transmission means and said receiver means being simultaneously operational.

16. The system of claim 15 further comprising a duplexer for connecting said transmitter means and said receiver means to said first and second patch antenna elements.

17. The system of claim 16 wherein said first radio signal is a pulse modulated signal; said second radio frequency signal is a portion of said first radio signal after reflection off a target; and further comprising measuring means for measuring a time delay between transmitting and receiving corresponding pulses of said pulse modulated signal; and determination means for determining a distance from said patch antenna elements to said target using said measured time delay.

18. The system of claim 15 wherein said first and second patch antenna elements each comprise two or more stacked layers of conducting material separated by an air gap, thereby reducing the antenna return loss.

19. The system of claim 18 wherein each of said stacked layers further comprises a substantially flat layer of conducting material containing one or more slots, thereby further reducing the antenna return loss.

20. The system of claim 18 further comprising one or more metal inserts between said first and second patch antenna elements.

* * * * *